US006412231B1

(12) United States Patent
Palatin

(10) Patent No.: US 6,412,231 B1
(45) Date of Patent: Jul. 2, 2002

(54) BLAST SHELTER

(76) Inventor: Amir Palatin, 5737 Kanan Rd., #146, Agoura Hills, CA (US) 91301

( * ) Notice: Subject to any disclaimer, the term of this patent is extended or adjusted under 35 U.S.C. 154(b) by 0 days.

(21) Appl. No.: 09/714,921

(22) Filed: Nov. 17, 2000

(51) Int. Cl.[7] ..... E04H 9/04

(52) U.S. Cl. ..... 52/79.1; 52/79.14; 52/169.6; 52/426; 52/431; 52/742.14; 109/1 S

(58) Field of Search ..... 52/169.6, 79.1, 52/79.11, 79.13, 79.14, 742.14, 426, 431, 425, 432, 439; 249/39; 109/1 S

(56) References Cited

U.S. PATENT DOCUMENTS

| | | | | | |
|---|---|---|---|---|---|
| 1,764,729 | A | * | 6/1930 | Koch | 52/742.14 |
| 3,233,022 | A | | 2/1966 | Rosenfeld | |
| 4,126,972 | A | | 11/1978 | Silen | |
| 4,622,788 | A | | 11/1986 | Paulsson et al. | |
| 5,048,244 | A | | 9/1991 | Barbier | |
| 5,596,855 | A | | 1/1997 | Batch | |
| 5,655,338 | A | | 8/1997 | Lucas | |
| 5,974,751 | A | * | 11/1999 | De Zen | 52/439 |

FOREIGN PATENT DOCUMENTS

| | | | | |
|---|---|---|---|---|
| CH | 666076 | * | 6/1988 | 52/169.6 |
| FR | 2511424 | * | 2/1983 | 52/169.6 |
| GB | 2134556 | * | 8/1984 | 52/169.6 |
| JP | 60-55126 | * | 3/1985 | 52/169.6 |
| JP | 5-44225 | * | 2/1993 | 52/169.6 |

OTHER PUBLICATIONS

American Iron and Steel Institute, "Steel Shelters for Fallout Protection", Dec. 1961, classification 109/1S.*

* cited by examiner

*Primary Examiner*—Laura A. Callo

(57) ABSTRACT

A blast shelter for protecting individuals during a blast or a natural disaster. The blast shelter includes an outer perimeter wall and an inner perimeter wall. The inner perimeter wall is positioned generally adjacent to the outer perimeter wall. A plurality of coupling members securely couples the inner perimeter wall to the outer perimeter wall such that the inner and outer perimeter walls are in a spaced relationship to each other. A door frame extends through the inner and outer perimeter walls. The door frame is securely attached to the inner and outer perimeter walls. A concrete material is poured between the inner and outer perimeter walls.

11 Claims, 5 Drawing Sheets

BLAST SHELTER

BACKGROUND OF THE INVENTION

1. Field of the Invention

The present invention relates to shelters and more particularly pertains to a new blast shelter for protecting individuals during a blast or a natural disaster.

2. Description of the Prior Art

The use of shelters is known in the prior art. More specifically, shelters heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,596,855; U.S. Pat. No. 4,622,788; U.S. Pat. No. 5,655,338; U.S. Pat. No. 3,233,022; U.S. Pat. No. 5,048,244; and U.S. Pat. No. 4,126,972.

While these devices fulfill their respective, particular objectives and requirements, the aforementioned patents do not disclose a new blast shelter. The inventive device includes an outer perimeter wall and an inner perimeter wall. The inner perimeter wall is positioned generally adjacent to the outer perimeter wall. A plurality of coupling means securely couples the inner perimeter wall to the outer perimeter wall such that the inner and outer perimeter walls are in a spaced relationship to each other. A door frame extends through the inner and outer perimeter walls, The door frame is securely attached to the inner and outer perimeter walls. A concrete material is poured between the inner and outer perimeter walls.

In these respects, the blast shelter according to the present invention substantially departs from the conventional concepts and designs of the prior art, and in so doing provides an apparatus primarily developed for the purpose of protecting individuals during a blast or a natural disaster.

SUMMARY OF THE INVENTION

In view of the foregoing disadvantages inherent in the known types of shelters now present in the prior art, the present invention provides a new blast shelter construction wherein the same can be utilized for protecting individuals during a blast or a natural disaster.

The general purpose of the present invention, which will be described subsequently in greater detail, is to provide a new blast shelter apparatus and method which has many of the advantages of the shelters mentioned heretofore and many novel features that result in a new blast shelter which is not anticipated, rendered obvious, suggested, or even implied by any of the prior art shelters, either alone or in any combination thereof.

To attain this, the present invention generally comprises an outer perimeter wall and an inner perimeter wall. The inner perimeter wall is positioned generally adjacent to the outer perimeter wall. A plurality of coupling means securely couples the inner perimeter wall to the outer perimeter wall such that the inner and outer perimeter walls are in a spaced relationship to each other. A door frame extends through the inner and outer perimeter walls. The door frame is securely attached to the inner and outer perimeter walls. A concrete material is poured between the inner and outer perimeter walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new blast shelter apparatus and method which has many of the advantages of the shelters mentioned heretofore and many novel features that result in a new blast shelter which is not anticipated, rendered obvious, suggested, or even implied by any of the prior art shelters, either alone or in any combination thereof.

It is another object of the present invention to provide a new blast shelter which may be easily and efficiently manufactured and marketed.

It is a further object of the present invention to provide a new blast shelter which is of a durable and reliable construction.

An even further object of the present invention is to provide a new blast shelter which is susceptible of a low cost of manufacture with regard to both materials and labor, and which accordingly is then susceptible of low prices of sale to the consuming public, thereby making such blast shelter economically available to the buying public.

Still yet another object of the present invention is to provide a new blast shelter which provides in the apparatuses and methods of the prior art some of the advantages thereof, while simultaneously overcoming some of the disadvantages normally associated therewith.

Still another object of the present invention is to provide a new blast shelter for protecting individuals during a blast or a natural disaster.

Yet another object of the present invention is to provide a new blast shelter which includes an outer perimeter wall and an inner perimeter wall. The inner perimeter wall is positioned generally adjacent to the outer perimeter wall. A plurality of coupling means securely couples the inner perimeter wall to the outer perimeter wall such that the inner and outer perimeter walls are in a spaced relationship to each other. A door frame extends through the inner and outer perimeter walls. The door frame is securely attached to the inner and outer perimeter walls. A concrete material is poured between the inner and outer perimeter walls.

Even still another object of the present invention is to provide a new blast shelter that uses light materials for ease of construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
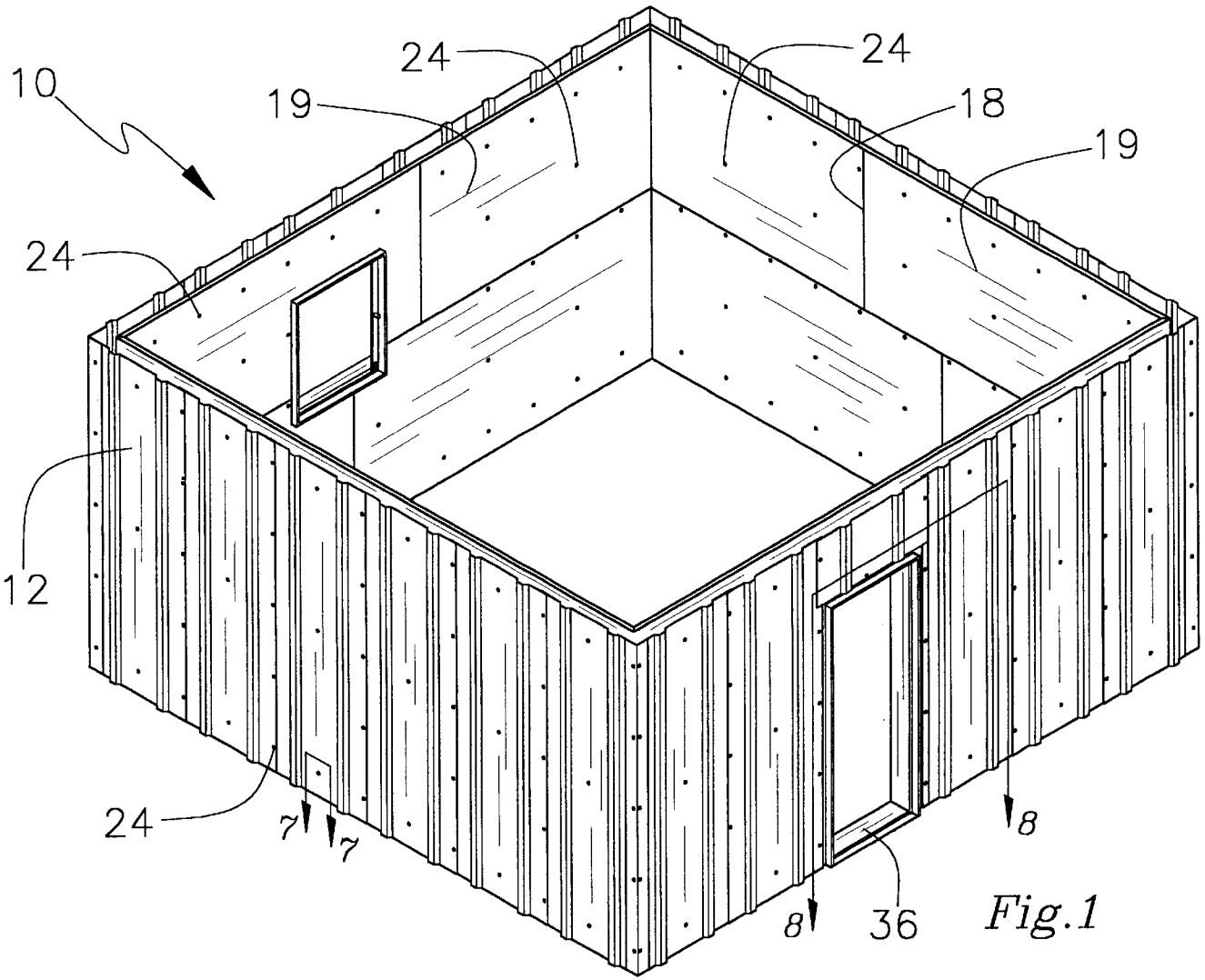
FIG. 1 is a schematic perspective view of a new blast shelter according to the present invention.

With reference now to the drawings, and in particular to FIGS. 1 through 9 thereof, a new blast shelter embodying the principles and concepts of the present invention and generally designated by the reference numeral 10 will be described.

As best illustrated in FIGS. 1 through 9. The blast shelter 10 generally includes an outer perimeter wall 12. The outer perimeter wall 12 comprises a plurality of panels 13. Each of the panels 13 has corrugations 14 therein. The corrugations 14 extend between the bottom and top edges of the outer perimeter wall 12. Each of the panels 13 is positioned such that an edge 15 of one panel 13 overlaps the edge of an adjacent panel 13. The respective adjacent panels 13 are securely attached together by a plurality of coupling means 24. Some of the panels have bends 16 therein and define corner panels 60. There are preferably four corner panels so that the outer perimeter wall 12 forms a housing. Each of the panels 13 comprises a substantially rigid material that is preferably sheet metal.

An inner perimeter wall 18 is positioned generally adjacent to the outer perimeter wall 12. The inner perimeter wall 18 comprises a plurality of plates 19. Each of the plates 19 preferably comprises a plastic material. Ideally, the plastic material is polyurethane foam material.

A mesh material 20, preferably comprising a wire mesh, is positioned between the inner 18 and outer 12 perimeter walls. The mesh material is made of metallic bars, such as rebar, woven together to form the mesh. The mesh material 20 may extend over a top edge of the inner perimeter wall 18 to define a roof portion 22.

A plurality of coupling means 24 securely couples the inner perimeter wall 18 to the outer perimeter wall 12. Each of the coupling means 24 comprises a rod 26 having a proximal portion 27, a middle portion 28 and a distal portion 29. The middle portions 28 have a thickness greater than a thickness of the proximal 27 and distal 29 portions. The distal portions 29 are extended through the outer perimeter wall 12 and the proximal portions 27 are extended through the inner perimeter wall 18 such that the middle portion 28 is positioned between the inner 18 and outer 12 perimeter walls and retains the outer 18 and inner 12 perimeter walls in a spaced relationship. A free end of the distal portion 29 has a head portion 30 thereon. A coupling member 31 is securely attached to a free end of the proximal portion 27.

Each of the plates 19 is positioned to substantially cover an inner surface of the outer perimeter wall 12. Each of the plates 19 is securely coupled to the outer perimeter wall 12 with a plurality of the coupling means 24.

Figure 2:
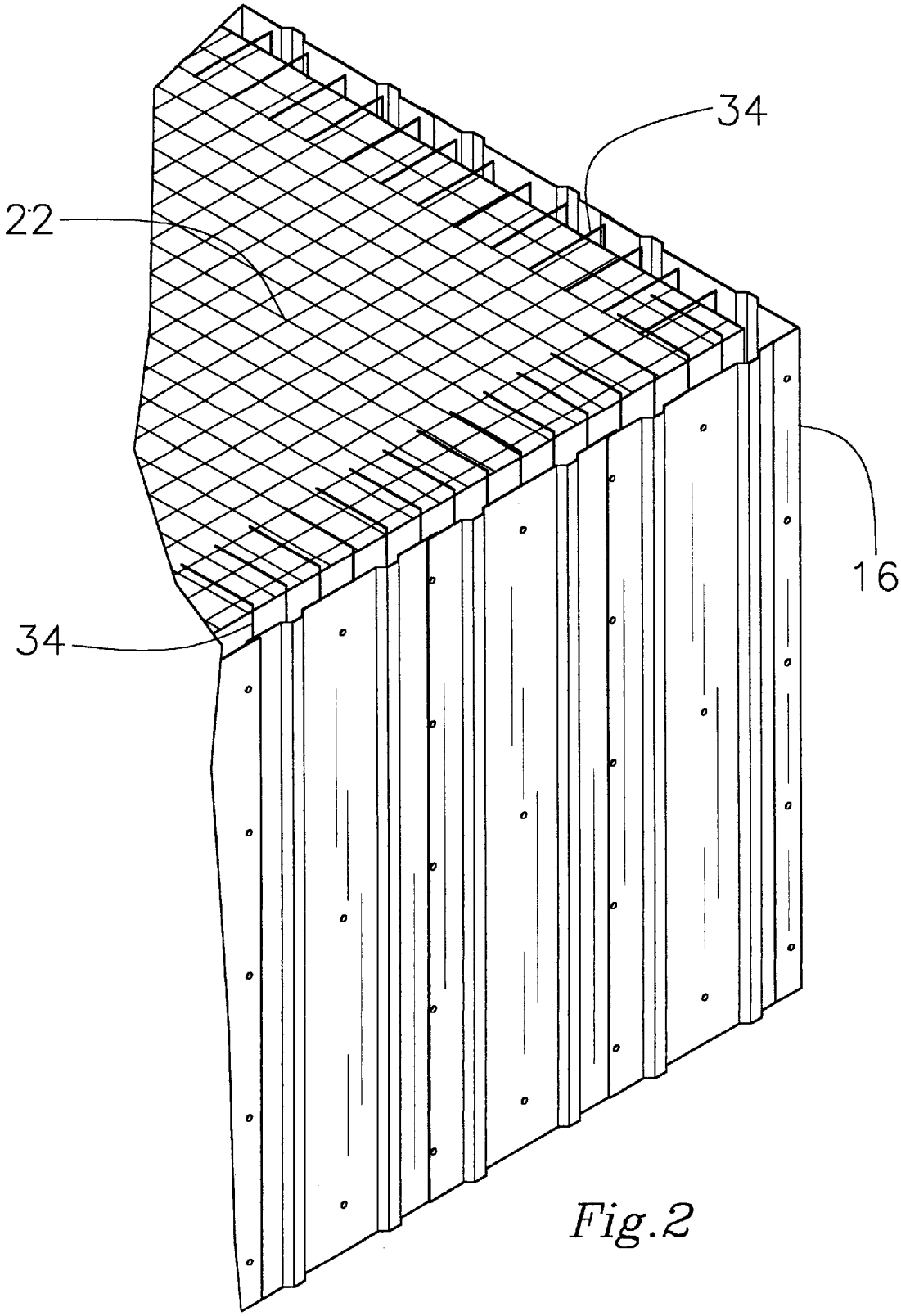
FIG. 2 is a schematic perspective top view of a corner of the present invention.
Figure 3:
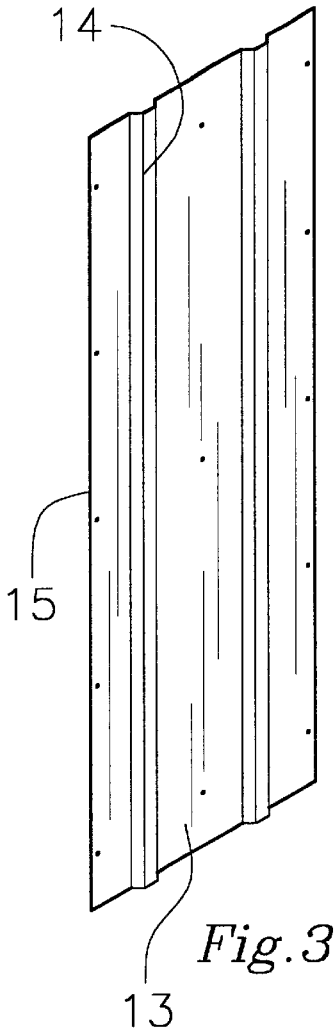
FIG. 3 is a schematic perspective view of a panel of the present invention.
Figure 4:
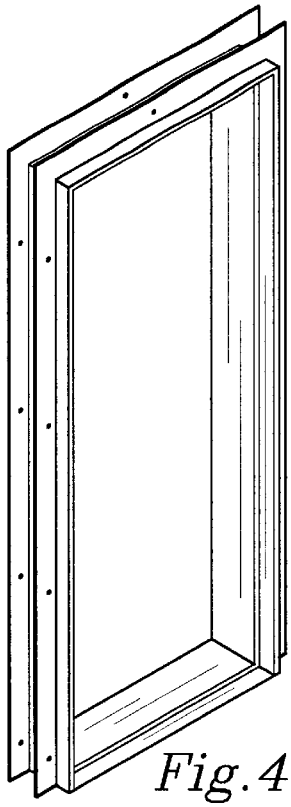
FIG. 4 is a schematic perspective view of the door frame of the present invention.
Figure 6:
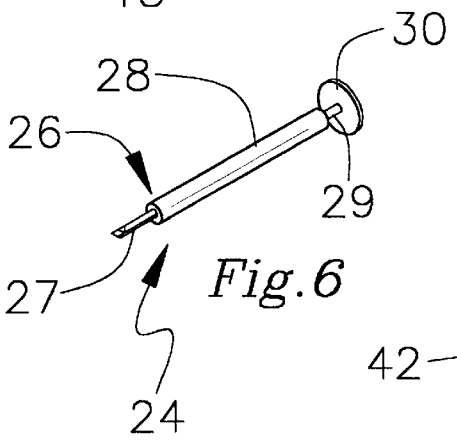
FIG. 6 is a schematic perspective view of the coupling means of the present invention.
Figure 5:
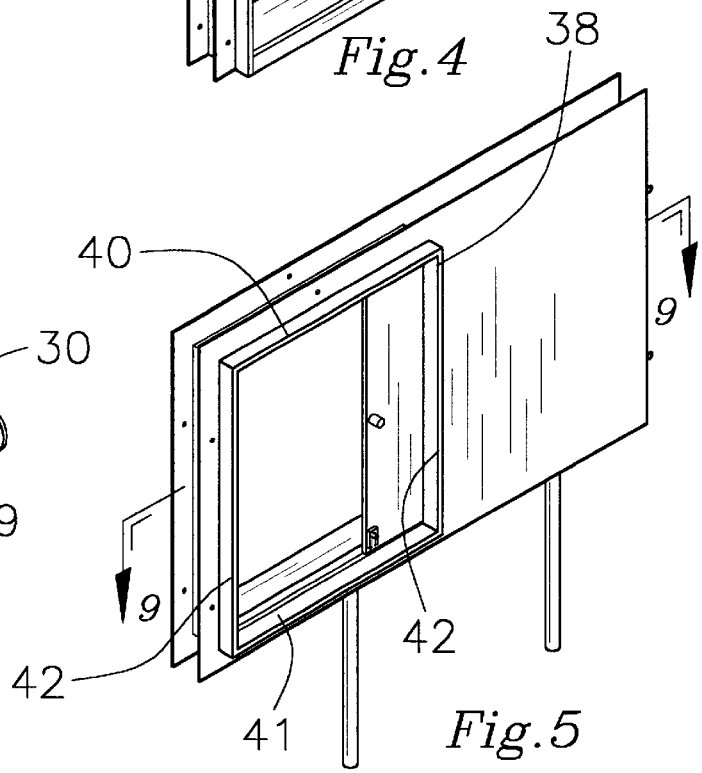
FIG. 5 is a schematic perspective view of the window frame of the present invention.
Figure 3A:
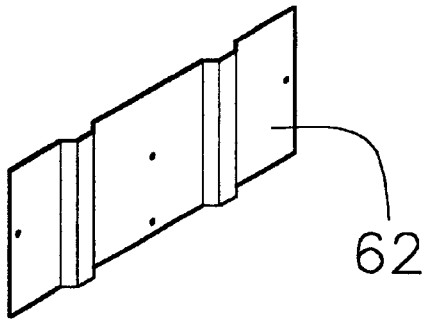
FIG. 3A is schematic perspective view of a panel of the present invention.
Figure 3C:
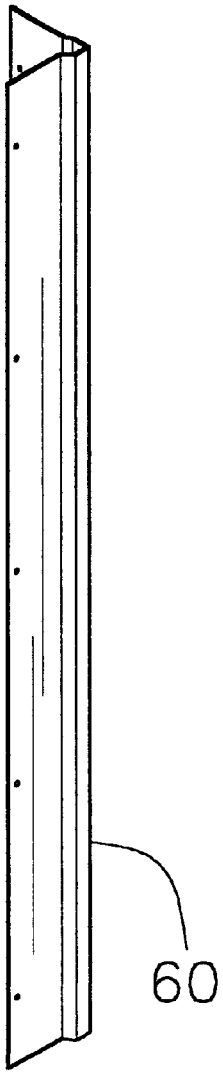
FIG. 3C is a schematic perspective view of a corner panel of the present invention.
Figure 3B:
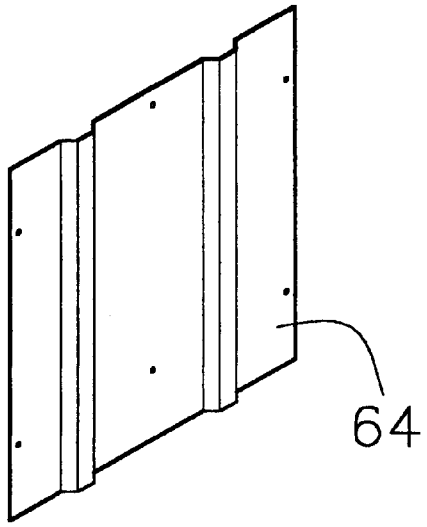
FIG. 3B is a schematic perspective view of a panel of the present invention.
Figure 7:
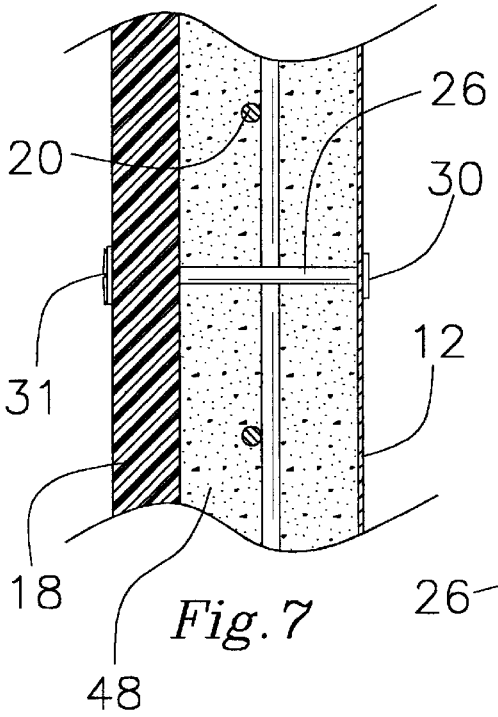
FIG. 7 is a schematic cross-sectional view taken along 7—7 of the present invention.
Figure 8:
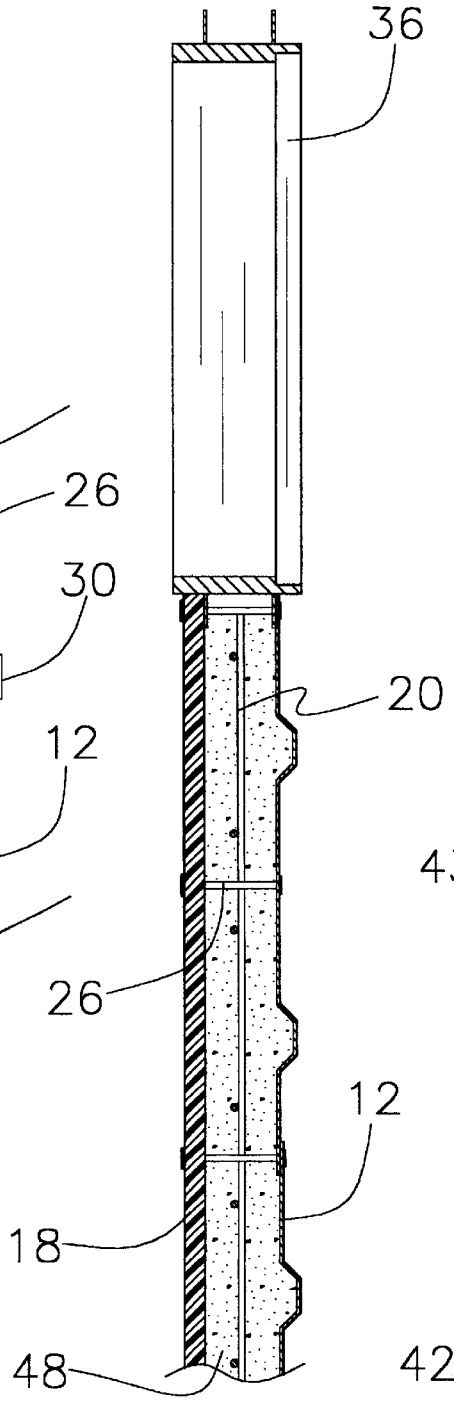
FIG. 8 is a schematic cross-sectional view taken along 8—8 of the present invention.
Figure 9:
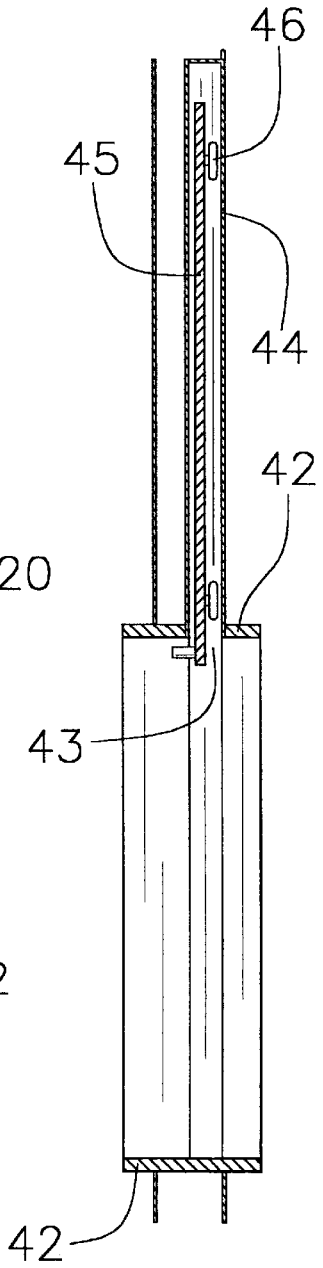
FIG. 9 is a schematic cross-sectional view taken along 9—9 of the window frame of the present invention.

A plurality of reinforcing bars 34, conventionally known as rebar made of metallic bars, is each positioned between the inner 18 and outer 12 perimeter walls. The reinforcing bars 34 are in a generally vertical orientation with respect to a concrete block, not shown, on which the inner 18 and outer 12 perimeter walls rest upon. The reinforcing bars 34 extend from the concrete block and upwardly over the top edge of the inner perimeter wall 18. They may be bent inward as shown in FIG. 2 to couple to the mesh forming the roof portion 22. The reinforcing bars 34 preferably extend into the concrete block.

A door opening and a window opening are formed in the walls by using a small panel 62 to form the tops of the door and window openings between two other panels 13. A medium panel 64 forms the bottom of the window opening. A door frame 36 is positioned in the door opening such that the door frame 36 extends through the inner 18 and outer 12 perimeter walls. The door frame 36 is securely attached to the inner 18 and outer 12 perimeter walls. The door frame is preferably made of steel and a steel door is preferably hingedly coupled to the door frame for selectively opening and closing the door opening. A window frame 38 is positioned in the window opening such that the window frame 38 extends through the inner 18 and outer 12 perimeter wall. The window fame 38, preferably made of steel, is securely attached to the inner 18 and outer 12 perimeter walls. The window frame 38 has a top wall 40, a bottom wall 41 and a pair of side walls 42. One of the side walls 42 has a slot 43 therein. The slot 43 extends between the top 40 and bottom 41 walls. A housing 44 extends away from the slot 43 such that the slot 43 opens into the housing 44. A door 45 is movably mounted in the housing 44 to selectively open and close an opening in the window frame 38. The door 45 preferably rides along rollers 46 for rolling in and out of the housing 44 to open and close the opening in the window frame 38. The door 45 is preferably made of steel.

A concrete material 48 is poured between the inner 18 and outer 12 perimeter walls. The concrete material 48 will harden to form permanent walls.

In use, the user typically erects the shelter 10 in their house on a concrete block, such as in a basement, during the construction of the house. The builder of the shelter 10 will construct the roof portion 22 by placing plates 19 on the bottom side of the roof portion 22, which are supported by temporary wooden scaffolds. A mesh material is positioned on top which concrete 48 is poured. The shelter 10 may be used to protect individuals as a blast shelter or from natural disasters such as earthquakes and tornadoes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A blast resistant shelter, said shelter being securely attached to and sitting upon a concrete block, said shelter comprising:

an outer perimeter wall;

an inner perimeter wall, said inner perimeter wall being positioned generally adjacent to said outer perimeter wall;

a plurality of coupling means for securely coupling said inner perimeter wall to said outer perimeter wall such that said inner and outer perimeter walls are in a spaced relationship to each other;

a door frame, said door frame extending through said inner and outer perimeter walls, said door frame being securely attached to said inner and outer perimeter walls;

a concrete material, said concrete material being poured between said inner and outer perimeter walls; and wherein said outer perimeter wall comprises a plurality of panels, each of said panels being corrugated, each of said panels being positioned such that an edge of one panel overlaps the edge of an adjacent panel, said adjacent panels being securely attached together, a portion of said panels having bends therein and defining corners.

2. The blast resistant shelter as in claim 1, wherein each of said panels comprises a sheet metal.

3. The blast resistant shelter as in claim 1, further comprising:

a mesh material being positioned between said inner and outer perimeter walls, said mesh material comprising a wire mesh, said wire mesh being comprised of a plurality of intertwined metallic bars.

4. The blast resistant shelter as in claim 3, wherein said inner perimeter wall comprises:

a plurality of plates, said plates being positioned to substantially cover an inner surface of said outer perimeter wall, each of said plates being securely coupled to said outer perimeter wall with a plurality of said coupling means, each of said plates comprising a plastic material.

5. The blast resistant shelter as in claim 4, further comprising:

a plurality of reinforcing bars, each of said reinforcing bars being positioned between said inner and outer perimeter walls, each of said reinforcing bars being in a generally vertical orientation with said concrete block, said reinforcing bars extending from said concrete block and upwardly over said top edge of said inner perimeter wall.

6. The blast resistant shelter as in claim 5, further comprising:

a window frame, said window frame extending through said inner and outer perimeter wall, said window frame being securely attached to said inner and outer perimeter walls.

7. The blast resistant shelter as in claim 6, wherein said window frame comprises:

a top wall, a bottom wall and a pair of side walls, one of said side walls having a slot therein, said slot extending between said top and bottom walls, a housing extending away from said slot such that said slot opens into said housing, a door being movably mounted in said housing to selectively open and close an opening in said window frame.

8. The blast resistant shelter as in claim 1, wherein each of said coupling means comprises:

a rod, said rod having a proximal portion, a middle portion and a distal portion, said middle portion having a thickness greater than a thickness of said proximal and distal portions, said distal portion being extended through said outer perimeter wall and said proximal portion being extended through said inner perimeter wall such that said middle portion is positioned between said inner and outer perimeter walls and retains such in a spaced relationship, a free end of said distal portion having a head portion thereon, a coupling member being securely attached to a free end of said proximal portion.

9. The blast resistant shelter as in claim 1, wherein said inner perimeter wall comprises:

a plurality of plates, said plates being positioned to substantially cover an inner surface of said outer perimeter wall, each of said plates being securely coupled to said outer perimeter wall with a plurality of said coupling means, each of said plates comprising a plastic material.

10. A method of making blast resistant shelter, said shelter being securely attached to and sitting upon a concrete block, said method comprising the steps of:

providing an outer perimeter wall, said outer perimeter wall comprising a plurality of panels, each of said panels having corrugations therein, each of said panels being positioned such that an edge of one panel overlaps the edge of an adjacent panel, said adjacent panels being securely attached together, a portion of said panels having bends therein and defining corners, each of said panels comprising a substantially rigid material, each of said panels comprising a sheet metal;

providing an inner perimeter wall, said inner perimeter wall being positioned generally adjacent to said outer perimeter wall, said inner perimeter wall comprising a plurality of plates, each of said plates comprising a plastic material;

providing a mesh material, said mesh material comprising a wire mesh, said wire mesh comprising plurality of intertwined metallic bars;

positioning said mesh material between said inner and outer perimeter walls, said mesh material extending over a top edge of said inner perimeter wall to define a roof portion;

providing a plurality of coupling means for securely coupling said inner perimeter wall to said outer perimeter wall, each of said coupling means comprising;

a rod, said rod having a proximal portion, a middle portion and a distal portion, said middle portion having a thickness greater than a thickness of said proximal and distal portions, said distal portion being extended through said outer perimeter wall and said proximal portion being extended through said inner perimeter wall such that said middle portion is positioned between said inner and outer perimeter walls and retains such in a spaced relationship, a free end of said distal portion having a head portion thereon, a coupling member being securely attached to a free end of said proximal portion;

positioning each of said plates to substantially cover an inner surface of said outer perimeter wall;

securely coupling each of said plates to said outer perimeter wall with a plurality of said coupling means;

providing a plurality of reinforcing bars, each of said reinforcing bars being positioned between said inner and outer perimeter walls, each of said reinforcing bars being in a generally vertical orientation with said concrete block, said reinforcing bars extending from said concrete block and upwardly over said top edge of said inner perimeter wall;

providing a door opening and a window opening extending through said inner and outer perimeter walls;

providing a door frame and positioning said door frame in said door opening such that said door frame extends through said inner and outer perimeter walls, said door frame being securely attached to said inner and outer perimeter walls;

providing a window frame and positioning said window frame in said window opening such that said window frame extends through said inner and outer perimeter wall, said window frame being securely attached to said inner and outer perimeter walls, said window frame having a top wall, a bottom wall and a pair of side walls, one of said side walls having a slot therein, said slot extending between said top and bottom walls, a housing extending away from said slot such that said slot opens into said housing, a door being movably mounted in said housing to selectively open and close an opening in said window frame;

providing a concrete material; and pouring said concrete material between said inner and outer perimeter walls.

11. A blast resistant shelter, said shelter being securely attached to and sitting upon a concrete block, said shelter comprising:

an outer perimeter wall, said outer perimeter wall comprising a plurality of panels, each of said panels having corrugations therein, each of said panels being positioned such that an edge of one panel overlaps the edge of an adjacent panel, said adjacent panels being securely attached together, a portion of said panels having bends therein and defining corners, each of said panels comprising a substantially rigid material, each of said panels comprising a sheet metal;

an inner perimeter wall, said inner perimeter wall being positioned generally adjacent to said outer perimeter wall; a a mesh material being positioned between said inner and outer perimeter walls, said mesh material extending over a top edge of said inner perimeter wall to define a roof portion, said mesh material comprising a wire mesh;

a plurality of coupling means for securely coupling said inner perimeter wall to said outer perimeter wall, each of said coupling means comprising;

a rod, said rod having a proximal portion, a middle portion and a distal portion, said middle portion having a thickness greater than a thickness of said proximal and distal portions, said distal portion being extended through said outer perimeter wall and said proximal portion being extended through said inner perimeter wall such that said middle portion is positioned between said inner and outer perimeter walls and retains such in a spaced relationship, a free end of said distal portion having a head portion thereon, a coupling member being securely attached to a free end of said proximal portion;

said inner perimeter wall comprising a plurality of plates, said plates being positioned to substantially cover an inner surface of said outer perimeter wall, each of said plates being securely coupled to said outer perimeter wall with a plurality of said coupling means, each of said plates comprising a plastic material;

a plurality of reinforcing bars, each of said reinforcing bars being positioned between said inner and outer perimeter walls, each of said reinforcing bars being in a generally vertical orientation with said concrete block, said reinforcing bars extending from said concrete block and upwardly over said top edge of said inner perimeter wall;

a door frame, said door frame extending through said inner and outer perimeter walls, said door frame being securely attached to said inner and outer perimeter walls;

a window frame, said window frame extending through said inner and outer perimeter wall, said window fame being securely attached to said inner and outer perimeter walls, said window frame having a top wall, a bottom wall and a pair of side walls, one of said side walls having a slot therein, said slot extending between said top and bottom walls, a housing extending away from said slot such that said slot opens into said housing, a door being mounted in said housing to selectively open and close an opening in said window frame;

a concrete material, said concrete material being poured between said inner and outer perimeter walls.

* * * * *